United States Patent [19]

Wojdasiewicz et al.

[11] 3,951,593

[45] Apr. 20, 1976

[54] METHOD FOR OBTAINING NUBUCK LEATHER SURFACES BY THERMAL CORRECTION OF GRAIN

[75] Inventors: Waldemar Wojdasiewicz; Krystyna Szumowska; Robert Morawiec, all of Lodz, Poland

[73] Assignee: Instytut Przemtslu Skorzanego, Lodz, Poland

[22] Filed: Apr. 11, 1974

[21] Appl. No.: 460,213

[30] Foreign Application Priority Data

Apr. 16, 1973 Poland ..... 161937

[52] U.S. Cl. ..... 8/94.15; 8/94.1 D; 8/150.5

[51] Int. Cl.[2] ..... C14C 1/00

[58] Field of Search ..... 8/94.15, 94.1 D, 150.5

[56] References Cited

UNITED STATES PATENTS 3,006,714 10/1961 Ushakoff ..... 8/94.18

3,048,929 8/1962 Kremen et al. ..... 8/94.1 D

*Primary Examiner*—Carman J. Seccuro

*Attorney, Agent, or Firm*—Haseltine, Lake & Waters

[57] ABSTRACT

The object of a invention is the method for obtaining nubuck leather surfaces by the thermal correction of grain in wet condition in the phases of production prior to tannage. In the specified, selected, phase of processing starting from soaking and ending with the pickling process the whole leather grain is subjected to the action of high temperatures ranging from 80–250°C. This thermal processing of the grain layer is carried out on equipment having a heating surface that permits attaining the temperatures mentioned above. The heating elements may be of the roller type (calenders or rolling mills) or flat plates (i.e. press). This equipment has to ensure contact of the whole grain surface with the heating element for 0.01 to 5.0 sec. Under the influence of high temperatures the protein keratohyalin layer is subjected to thermal denaturation.

2 Claims, 1 Drawing Figure

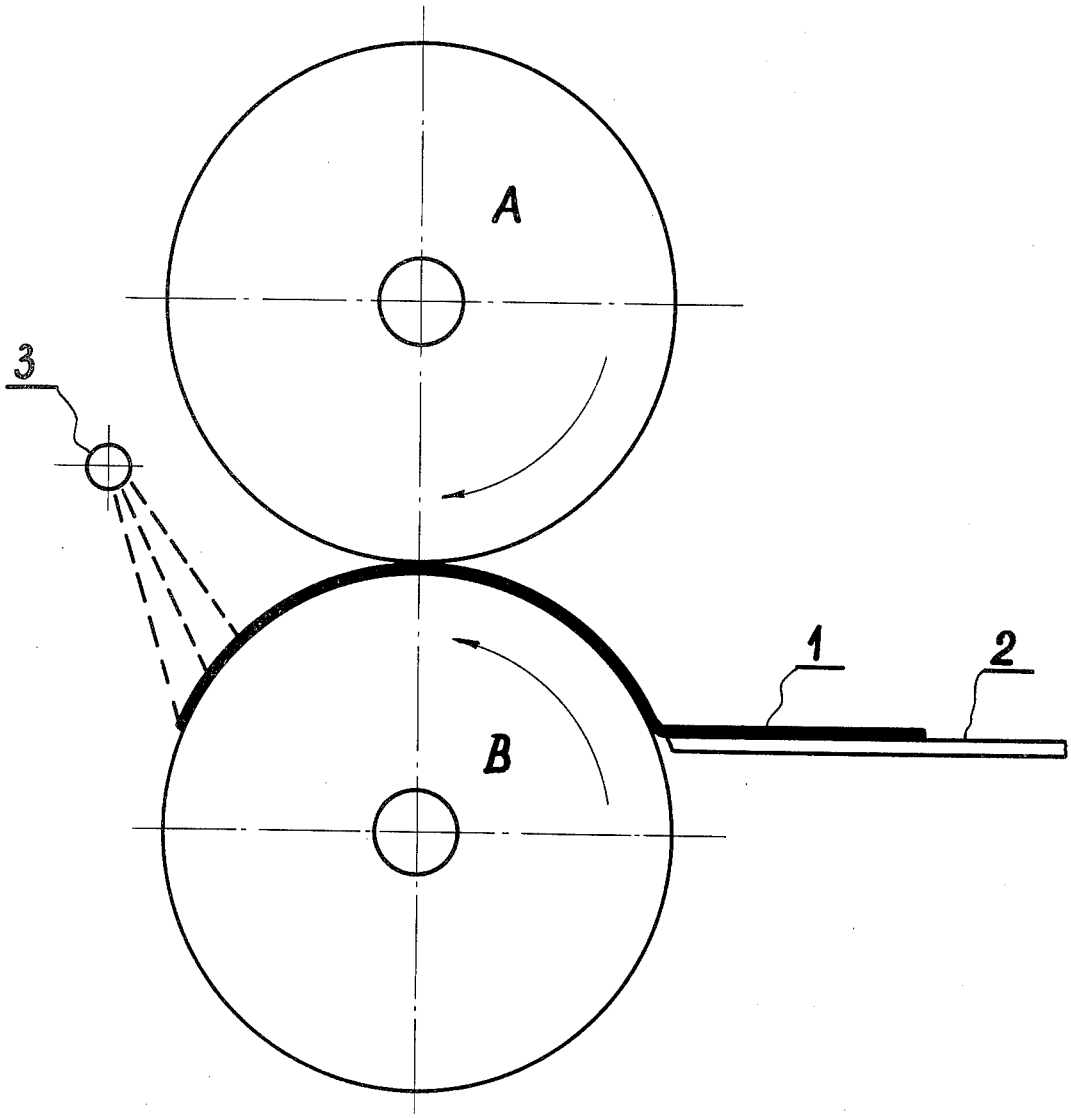
A
3
1
2
B

METHOD FOR OBTAINING NUBUCK LEATHER SURFACES BY THERMAL CORRECTION OF GRAIN

The object of the invention is a method for obtaining nubuck leather surfaces by the thermal correction process of the grain, in wet condition, prior to tannage.

The leather industry produces and processes yearly tens of thousands of tons of nubuck leathers for shoe uppers, clothing, and fancy goods. Various kinds of leather that after mechanical processing have more or less fibrous grain surface are called nubucks. The thin layer placed directly under the cuticle is called a leather grain, it is defined also as hyalin or keratohyalin. This layer due to its high resistance to chemicals applied during the treatment practically is not affected. All damages of the mechanical or biological type are considered as defects.

Nubuck surfaces obtained according to the techniques up to now are based on multidirectional snuffing or skiving and snuffing the leather grain after tanning and only in the dry state, i.e. after unloading hides out of drums, shaving, reloading drums, neutralization, fat liquoring, unloading, squeezing, paste drying, removing from plates and wetting operations. After grain snuffing the hides again are loaded into drums, soaked, dyed, fat-liquored unloaded, squeezed, set, dried, wetted, soaked, stretched on plates and dried again. As one may see, from what was said above, the present technique and technology of obtaining leather with a fibrous grain surface is a labor and time-consuming process and causes a double exploitation of machines and equipment which affect the productivity of the plant. The said technique of obtaining nubuck surfaces by the correction of the grain by mechanical hide processing is not able to assure also the correct quality of leathers having deeper scarred over, biological or mechanical damages of the hyalin layer and therefore a lot of them have to be processed for less valuable leathers, so called velours, with buffing flesh side. The mechanical techniques for obtaining nubuck surfaces, in the dry state, is currently the only processing technique which is known and applied for that purpose.

The object of this invention is to obtain nubuck surfaces by the thermal correction of the grain. It consists in that in specified, selected phase of processing in a beamhouse, starting from soaking and ending with pickling, a whole grain is subjected to the high temperatures, ranging from 80°–250° C. This thermal processing of grain layer (keratohyalin) is carried out on equipment having a heating surface that permits attaining the temperatures mentioned above. The heating elements may be of the roller type (i.e. calenders or rolling mills) or flat plates (i.e. press). This equipment working continuously or periodically has to ensure contact of the whole surface of the leather grain, through feeding elements, with the heating surface for 0.01 to 5.0 sec. Under the influence of the heat protein, keratohyalin layer is subjected to the thermal denaturation at a uniform rate on the whole surface of the leather, because the effects that might occur due to the defined high temperature, influencing the grain surface unit, at a constant heat conductivity of water, will always be proportional to the time and temperature gradients. On simultaneous cooling of the flesh side to the specified temperature the range of action of short-lived, high temperatures will be always limited to the superficial denaturation of the grain layer. The thickness of this layer may be 0.01 to 0.3 mm for given temperatures and the time of their action. The remaining layer of hide under these conditions is not able to reach the shrinkage temperature and it is not subjected to any thermal changes. After the thermal processing, hides are further processed adopting the normal tanning processes and after the alkaline treatment the denaturated grain separates spontaneously as pieces of following thicknesses 0.01 to 0.3 mm, depending on requirements, making a fibrous surface on the top layer of the leather.

Depending on the processing phase in which the thermal treatment of the grain layer is carried out, the temperature and the time of its action, a piece of leather coming apart may have the optional, controlled thickness, and what goes after, the formed surface may be less or more fibrous. Removing of the keratohyalin layer from the leather surface just in the first phase of the treatment facilitates the penetration of chemicals and the open surface due to a long-lasting friction in further operations in drums makes a soft, "velvety", fibrous in a standard way, nubuck surface.

The effect of applying thermal processing of the hide grain layer in a phase prior to the tannage is to obtain nubuck leathers through normal tanning processes with the elimination of mechanical treatment used up to now, and thus the double operations taking place in the mechanical treatment of grain surfaces in a dry condition. The thermal treatment may be used also for, so called, corrected grains before coating for specified leather assortments.

EXAMPLE

After soaking and bath degreasing, hides are subjected to cleaning of the flesh side on a fleshing machine, shaved on shaving or splitting machines, subjected to hair removing by enzymatic or mechanical processes and then they are thermally processed between two rollers according to the principle given in FIG. 1, where the letter "A" is the heated metal roll, the letter "B" the cooled metal roll, (1) leather grain, (2) feeding table, (3) cooling with water.

After the thermal treatment hides are limed in a strong lime liquor according to conventional methods. The separation of the grain layer occurs during the alkaline swelling of hides in the lime liquor. The remaining tanning processes are carried out without changes, the same way as for grain leathers. Just after mechanical equalization of thicknesses hides are dyed, fat-liquored and finished according to the methods provided for nubuck leathers except snuffing and skiving.

What is claimed is:

1. A method for obtaining a nubuck leather surface by thermal correction of the grain surface of wet leather prior to tanning comprising contacting the wet grain surface with a heating element surface for 0.01–5.0 sec. at a temperature higher than the shrinkage temperature of the grain surface, said temperature being in the range of from 80°C to 250°C.

2. The method of claim 1 wherein the heating element surface is in the shape of a roller or a plate.

* * * * *